United States Patent [19]

Kikuta

[11] Patent Number: 4,639,067

[45] Date of Patent: Jan. 27, 1987

[54] SHIELD STRUCTURE FOR ELECTRIC CONNECTORS

[75] Inventor: Sigeru Kikuta, Tokyo, Japan

[73] Assignee: Hirose Electric Co., Ltd., Tokyo, Japan

[21] Appl. No.: 776,878

[22] Filed: Sep. 17, 1985

[30] Foreign Application Priority Data

Oct. 16, 1984 [JP] Japan ..... 59-216850

[51] Int. Cl.[4] ..... H01R 4/66

[52] U.S. Cl. ..... 339/143 R; 339/14 R

[58] Field of Search ..... 339/14 R, 143 R, 143 P, 339/147 R

[56] References Cited

U.S. PATENT DOCUMENTS

| | | | |
|---|---|---|---|
| 4,337,989 | 7/1982 | Asick et al. | 339/143 R |
| 4,449,778 | 5/1984 | Lane | 339/143 R |
| 4,457,575 | 7/1984 | Davis et al. | 339/143 R |
| 4,536,045 | 8/1985 | Reichardt et al. | 339/143 R X |

FOREIGN PATENT DOCUMENTS 59-12583 1/1984 Japan .

59-5579 1/1984 Japan .

*Primary Examiner*—Eugene F. Desmond

*Attorney, Agent, or Firm*—Fleit, Jacobson, Cohn & Price

[57] ABSTRACT

There is disclosed a shield structure for a pair of electric connectors each of which includes an insulating housing with a contact disposed therein, and a conductive shield case surrounding the insulating housing, and the connectors being snugly fitted to each other. In the shield structure, an earth plate is disposed on at least one side wall of the insulating housing of one of the electric connectors. A part of the earth plate is held in touch with the conductive shield case in a manner such that it is held between the conductive shield case and the insulating housing, and another part of the earth plate lies above the side wall of the insulating housing and is exposed outside the conductive shield case. When the one electric connector and the other electric connector are snugly fitted, the conductive shield case of the other electric connector touches the other part of the earth plate, whereby both the conductive shield cases are brought into earth connection through the earth plate.

3 Claims, 5 Drawing Figures

FIG. 2
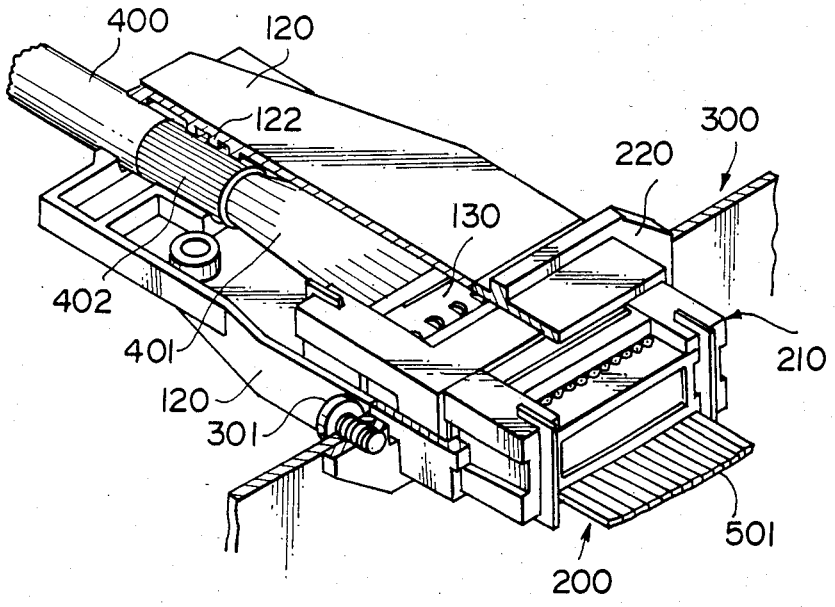
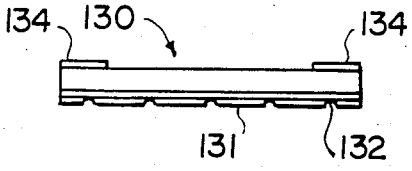
FIG. 3A
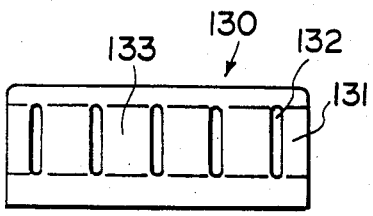
FIG. 3B
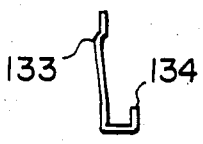
FIG. 3C

SHIELD STRUCTURE FOR ELECTRIC CONNECTORS

BACKGROUND OF THE INVENTION

1. Field of the Invention

The present invention relates to electric connectors and shield devices therefor, which are used to defend against electromagnetic wave disturbance.

2. Description of the Prior Art

Recently, defense against electromagnetic wave disturbance has become necessary for electronic equipment such as a computer etc., and various electric connectors intended to be used to defend circuits from electromagnetic wave disturbance have been disclosed as electric connectors for use in the electronic equipment.

By way of examples, electric connectors are disclosed in the official gazettes of Japanese Patent Application Laying-open Nos. 59-5579 and 59-12583. In these electric connectors, an elastic clip member or earth plate is mounted on a connector housing so as to reliably establish a shield connection with an opposite connector.

Such prior-art electric connectors, however, have the following problems:

(1) Since the clip member or earth plate is constructed so as to lie near the contacts, breakdown voltage and insulation resistance are demeritorious. Moreover, since the clip or plate approaches the contacts, leakage occurs when a radio frequency current flows through the contacts.

(2) Special machining is performed for mounting the clip member or earth plate to a shell, so that the structure of the shell is complicated and the assemblage is accordingly complicated. Therefore, a high price is inevitable.

(3) In a connector disclosed in the official gazette of Japanese Patent Application Laying-open No. 59-12583, an earth plate is mounted on only a part of an insulator housing, and hence, it is impossible to defend the connector from electromagnetic wave disturbance perfectly.

(4) In a connector disclosed in the official gazette of Japanese Patent Application Laying-open No. 59-5579, the spring plate arm of a clip member is fine and is low in mechanical strength. Nevertheless, the contact area of the face of the arm during an inserting or drawing-out (removal) operation is large. Therefore, the repetition of the inserting and drawing-out operations of the connector is liable to cause a drawback such that the arm undergoes permanent strain or damage.

An object of the present invention is to eliminate the disadvantages of the prior-art connectors as described above, and to provide a shield structure for electric connectors which is simple in construction, low in cost and high in touching reliability.

SUMMARY OF THE INVENTION

According to the present invention, there is provided a shield structure for a pair of electric connectors each of which comprises an insulating housing with a contact disposed therein, and a conductive shield case surrounding the insulating housing, the electric connectors being snugly fitted to each other, comprising an earth plate which is disposed on at least one side wall of the insulating housing of one of the pair of electric connectors, a part of which is held in touch with the conductive shield case in a manner such that it is held between the conductive shield case and the insulating housing, and another part of which lies above the side wall of the insulating housing and is exposed outside the conductive shield case, so that when the one electric connector and the other electric connector are snugly fitted, the conductive shield case of the other electric connector touches the other part of the earth plate, whereby both the conductive shield cases are brought into earth connection through the earth plate.

The present invention will be described in further detail in conjunction with embodiments thereof with reference to the accompanying drawings.

BRIEF DESCRIPTION OF THE DRAWINGS

FIG. 2 is a perspective view, partly broken away, showing a state after the connectors in FIG. 1 are snugly fitted;

FIGS. 3A, 3B and 3C show enlarged views of an earth plate for use in the connectors in FIG. 1;

DESCRIPTION OF THE PREFERRED EMBODIMENTS

Referring now to the accompanying drawings, the present invention will be described in more detail in conjunction with an embodiment thereof.

Figure 1:
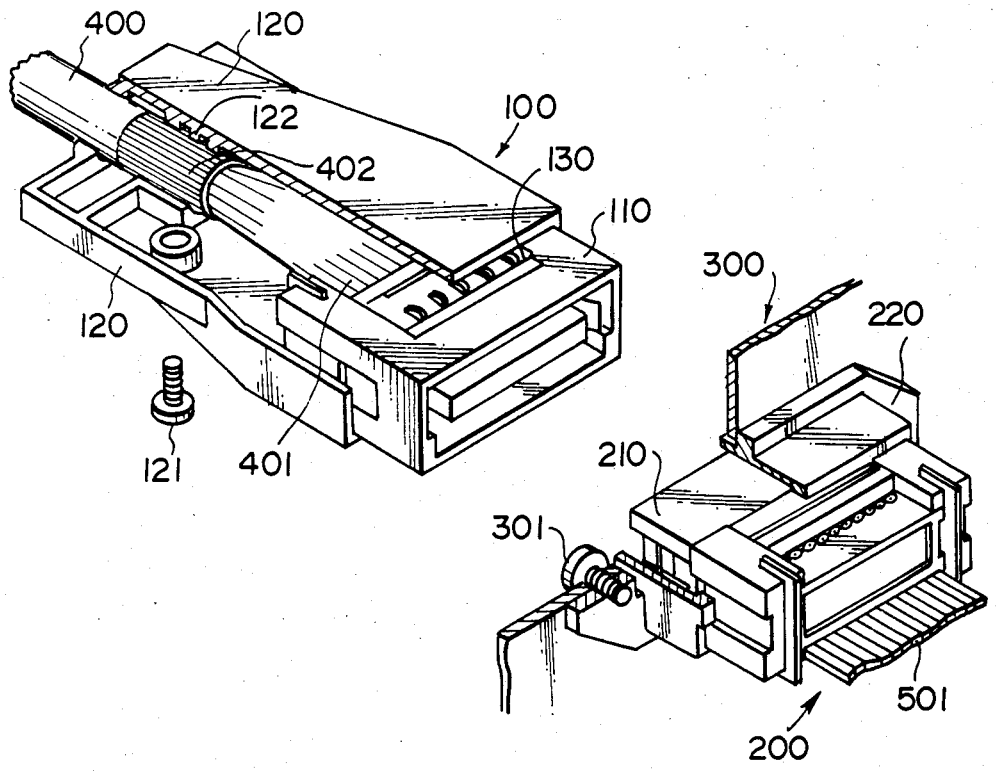
FIG. 1 is a perspective view, partly broken away, showing a state before a plug connector and a receptacle connector using the shield structure of the present invention are snugly fitted.

FIG. 1 is a perspective view, partly broken away, showing the state of a plug connector and a receptacle connector using the shield structure of the present invention before they are snugly fitted. In this embodiment, the plug connector 100 principally comprises a male insulating housing 110 in which a male contact is disposed, and a pair of plug cases 120 which constitute a conductive shield case surrounding the male insulating housing 110. The plug cases 120 are assembled to each other so as to sandwich the male insulating housing 110 from both the sides thereof and are clamped and fixed, using screws 121, thereby mounting around the male insulating housing 110.

On the other hand, the receptacle connector 200 principally comprises a female insulating housing 210 in which a female contact is disposed, and a receptacle case 220 which constructs a conductive shield case surrounding the female insulating housing 210. The receptacle case 220 of this receptacle connector 200 is mounted and fixed on a mounting panel 300 with a clamping screw 301 so as to be earthed or grounded.

The plug connector 100 is further provided with earth plates 130 at both the side walls of the male insulating housing 110. A part of the earth plate 130 touches the plug cases 120 in a manner to be held between the plug cases 120 and the male insulating housing 110, while another part of the earth plate 130 lies above the corresponding side wall of the male insulating housing 110 and is exposed outside the plug case 120.

The earth plate 130 is unitarily formed of a springy metal sheet as particularly illustrated in a plan view, a front view and a side view of FIGS. 3A, 3B and 3C respectively. The cross section of the earth plate 130 is substantially in the shape of letter L (see FIG. 3C), and a planar portion 131 is provided with a plurality of slits 132. The upper part of the planar portion 131 is provided with a contiguous portion 133 which serves for earth connection in touch with the inner side surfaces of the plug cases 120 and the receptacle case 220. Further, the lower part of the planar portion 131 is provided with U-shaped engaging portions 134 on both the sides thereof.

Figure 4:
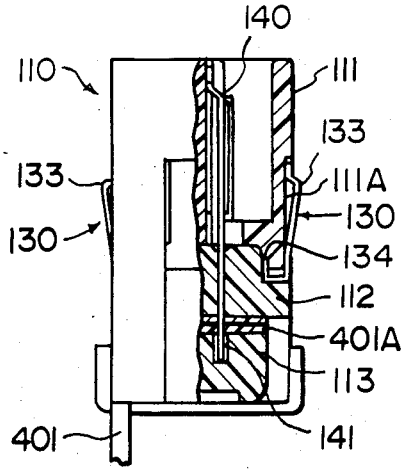
FIG. 4 is a half sectional side view showing the state in which the earth plates are assembled in a male insulating housing.

A method of attaching and fixing the earth plate 130 to the side wall of the male insulating housing 110 will be explained by referring especially to FIG. 4. FIG. 4 is a half sectional side view showing the state in which the earth plates 130 are assembled on the male insulating housing 110. As best shown in FIG. 4, the male insulating housing 110 is composed of an insulating housing proper 111 in which the male contact 140 is disposed, an insulating keeper housing 112, and a cable restraint plate 113. The side wall of the insulating housing proper 111 is formed with a shallow slot 111A in which the planar portion 131 of the earth plate 130 is received. As illustrated in FIG. 4, the earth plate 130 is assembled and fixed to the side wall portion of the insulating housing proper 111 by assembling the insulating keeper housing 112 to the lower end of the insulating housing proper 110 in the state in which the planar portion 131 is arranged in the slot 111A of the insulating housing proper 111 and in which the engaging portion 134 is held in engagement with the lower end part of the insulating housing proper 111. At this time, the contiguous portion 133 of the earth plate 130 protrudes out of the outer wall surface of the insulating housing proper 111.

As best shown in FIG. 1, such plug connector 100 has a cable 400 connected thereto. A method of connecting the cable 400 will be briefly explained. First, the terminal part of the cable 400 to be connected is stripped, a cable core 401 is disjointed, and a cable shield 402 is folded back onto the armor of the cable 400. As best shown in FIG. 4, the end part 401A of the cable core 401 is connected to the splicing portion 141 of the male contact 140 by the use of the cable restraint plate 113, the aforementioned splicing portion being arranged in the insulating housing proper 111 and being projected beyond the lower end face of the insulating keeper housing 112. Secondly, as best shown in FIG. 1, the pair of plug cases 120 are assembled together from both the sides of the male insulating housing 110, and they are clamped and fixed using the clamping screws 121. At this time, a cable clamp portion 122 provided inside the rear end of each plug case 120 comes into touch with the cable shield 402 folded back on the armor of the cable 400, in a manner to bite therein, and the inner side of the fore end of the plug case 120 comes into pressed touch with the contiguous portion 133 of the earth plate 130.

Figure 5:
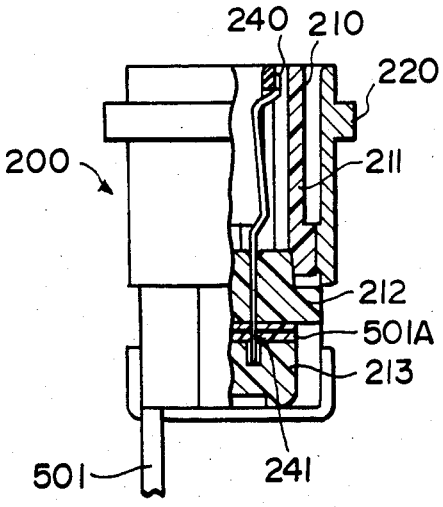
FIG. 5 is a half sectional side view for elucidating the connected state of the receptacle connector.

Meanwhile, as best shown in a half sectional side view of FIG. 5, the female insulating housing 210 of the receptacle connector 200 is composed of an insulating housing proper 211 in which the female contact 240 is disposed, an insulating keeper housing 212, and a cable restraint plate 213. The end part 501A of a cable core 501 to be connected is connected to the splicing portion 241 of the female contact 240 by the use of the cable restraint plate 213, the aforementioned splicing portion being arranged in the insulating housing proper 211 and being projected beyond the lower end face of the insulating keeper housing 212.

Shown in a fragmentary perspective view of FIG. 2 is the state under which the plug connector 100 connected as described above is snugly fitted in the receptacle connector 200 connected and also attached and fixed to the mounting panel 300 as described above. As illustrated in FIG. 2, under this state, the earth connection of a path extending along the cable shield 402 of the cable 400—the cable clamp portions 122—the plug cases 120—the contiguous portions 133 of the earth plates 130—the receptacle case 220—the mounting panel 300 is reliably performed.

While, in the foregoing embodiment, the earth plates are provided on the plug connector side, they may well be provided on the receptacle connector side.

As understood from the above description, in accordance with the shield structure for electric connectors according to the present invention, the following effects can be attained:

(1) Since earth plates are far away from contacts, the breakdown voltage and the insulation resistance do not become demeritorious, and even a radio frequency current passing through the contacts does not leak.

(2) The structure of the side faces of a connector unit for mounting the earth plates is simple without requiring any special machining, and the structure of the earth plates themselves is also simple, so that the assemblage is easy and is possible at low cost.

(3) Plug cases and a receptacle case form a completely touching structure in the state in which they are snugly fitted, so that electric wave disturbance can be perfectly prevented.

(4) Since those contiguous portions of the earth plates, in the plug cases and the receptacle cases touch each other, their mechanical strength can be increased and the drawback that the earth plates undergo permanent strain or damage due to the repeated inserting and drawing-out operations of connectors is not present.

I claim:

1. In a pair of electric connectors each of which comprises an insulating housing with a contact disposed therein and a conductive shield case surrounding the insulating housing, and which are coupled to each other, a shield structure characterized in that the insulating housing of one of said electric connectors has a portion protruding beyond the forward end of the conductive shield case of said one electric connector and adapted to be fitted into the conductive shield case of the other of said electric connectors, the conductive shield case of said one electric connector is provided on the inner wall of the rear end thereof with a cable clamp portion for coming into contact with the cable shield of a cable to be connected thereto, the forward end surface of the conductive shield case of said one electric connector is adapted to abut on the forward end surface of the conductive shield case of said other electric connector when said one electric connector is coupled to said other electric connector, earth plates are disposed on either outer side walls of the insulating housing of said one electric connector, a part of each of said earth plates being sandwiched between the inner wall of the conductive shield case of said one electric connector and the outer side wall of the insulating housing of said one electric connector so as to make contact with the inner wall of the forward end of the conductive shield case of said one electric connector and another part of each of said earth plates being laid on the outer side wall of the insulating housing of said one electric connector so as to be exposed outside the conductive shield case of said one electric connector, and said exposed part of each earth plate is adapted to come into the forward end of the conductive shield case of said other electric connector so as to make contact with the inner wall of the forward end of the conductive shield case of said other electric connector when said one electric connector is coupled to said other electric connector, whereby each of said earth plates extends across the abutting line of the forward end surface of the conductive shield case of said one electric connector past the forward end surface of the conductive shield case of said other electric connector so as to electrically connect the conductive shield case of said one electric connector to the conductive shield case of said other electric connector so that the cable shield of said cable can be positively and electrically connected to the conductive shield case of said other electric connector through said cable clamp portion, the body of the conductive shield case of said one electric connector and each of said earth plates.

2. A shield structure as defined in claim 1, wherein the insulating housing of said one electric connector is divided into at least two units, and each of said earth plates is fixed to said outer side wall of the insulating housing of said one electric connector by having one end thereof held between said units when said units are assembled together.

3. A shield structure as defined in claim 1, wherein said insulating housing of said one electric connector extends beyond said earth plates.

* * * * *